US008915109B2

(12) United States Patent
Cha

(10) Patent No.: US 8,915,109 B2
(45) Date of Patent: Dec. 23, 2014

(54) MANUFACTURING APPARATUS AND METHOD OF SPIRAL DUCT INCLUDING ELBOW

(75) Inventor: Kyu-seok Cha, Hwaseong-shi (KR)

(73) Assignee: Jinwoong Technology Co., Ltd., Hwaseong-Shi, Kyonggi-Do (KR)

( * ) Notice: Subject to any disclaimer, the term of this patent is extended or adjusted under 35 U.S.C. 154(b) by 813 days.

(21) Appl. No.: 12/993,719

(22) PCT Filed: May 22, 2008

(86) PCT No.: PCT/KR2008/002852

§ 371 (c)(1),
(2), (4) Date: Nov. 19, 2010

(87) PCT Pub. No.: WO2009/142343

PCT Pub. Date: Nov. 26, 2009

(65) Prior Publication Data

US 2011/0072875 A1 Mar. 31, 2011

(51) Int. Cl.

| | |
|---|---|
| ***B21C 37/12*** | (2006.01) |
| ***B21B 3/00*** | (2006.01) |
| ***B21B 1/00*** | (2006.01) |
| ***B21D 11/06*** | (2006.01) |

(52) U.S. Cl.

CPC ..... *B21D 11/06* (2013.01); *B21C 37/127* (2013.01); *B21C 37/121* (2013.01); *B21C 37/126* (2013.01); *B21C 37/125* (2013.01)

USPC ..... 72/50; 72/203; 72/127

(58) Field of Classification Search

USPC ..... 72/49, 50, 203, 132, 135, 48, 368, 127, 72/367.1, 146; 29/890.149

See application file for complete search history.

(56) References Cited

U.S. PATENT DOCUMENTS 3,731,512 A * 5/1973 Vogel et al. ..... 72/203
5,014,424 A 5/1991 Takasugi (Continued)

FOREIGN PATENT DOCUMENTS

KR 2019940006932 Y1 10/1994
KR 20-0232329 Y1 9/2001

(Continued)

OTHER PUBLICATIONS

International Search Report of International Application No. PCT/KR2008/002852, dated Feb. 11, 2009.

*Primary Examiner* — Shelley Self
*Assistant Examiner* — Mohammad I Yusuf
(74) *Attorney, Agent, or Firm* — Kile Park Reed & Houtteman PLLC

(57) ABSTRACT

Provided is a manufacturing method of a spiral duct including an elbow. The manufacturing method includes: bending projecting wave portions of metal plate members upward by a ball caster, the metal plate members being cut in such a manner that a straight lines and waves are formed; transferring the metal plate members using a pair of transfer rollers which are rotated by a first motor installed in a manufacturing apparatus of a spiral duct including an elbow; pressing a single folded portion and a double folded portion of the metal plate members using upper and lower pressing rollers while the transferred metal plate members are rolled into a circular shape by a joint jig; and cutting the elbow formed by the manufacturing apparatus using upper and lower cutters. According to the invention, an elbow curved at a gentle angle can be formed, and the projecting wave portions of the metal plate members are bent so as to form the elbow. Therefore, a fluid can smoothly flow along the curved portion of the elbow. Further, as the elbow is formed by consecutive processes, it is possible to increase productivity.

18 Claims, 23 Drawing Sheets

(56) References Cited

U.S. PATENT DOCUMENTS

| | | | | |
|---|---|---|---|---|
| 7,328,510 | B2 * | 2/2008 | Munoz | 29/890.149 |
| 7,730,754 | B2 * | 6/2010 | Cha et al. | 72/50 |
| 7,797,805 | B2 * | 9/2010 | Rieck | 72/368 |
| 7,849,772 | B2 * | 12/2010 | Monteil | 72/238 |
| 8,522,587 | B2 * | 9/2013 | Cha | 72/49 |

FOREIGN PATENT DOCUMENTS

| | | | |
|---|---|---|---|
| KR | 100599078 | B1 | 7/2006 |
| KR | 100646808 | B1 | 11/2006 |
| KR | 100862014 | B1 | 10/2008 |

* cited by examiner

MANUFACTURING APPARATUS AND METHOD OF SPIRAL DUCT INCLUDING ELBOW

TECHNICAL FIELD

The present invention relates to a manufacturing apparatus and method of a spiral duct including an elbow, and more specifically, to a manufacturing apparatus and method of a spiral duct including an elbow, which cuts a metal plate member into a wave shape and winds the cut metal plate member into a cylindrical shape to form a spiral duct including an elbow.

BACKGROUND ART

In general, spiral ducts are widely used in air handling units, pipelines for transferring particles and so on.

An apparatus for manufacturing a spiral duct has a plurality of pressing rollers arranged in a plurality of lines. While a thin metal plate member wound around a reel stand passes through the pressing rollers, both ends of the metal plate member are bent away from each other. Then, as the metal plate member is pressed by the pressing rollers while the bent portions of both ends of the metal plate member are coupled to each other, the metal plate member is formed into a cylinder. At this time, as the metal plate member is guided while being supported by three to five projecting guide rods installed along the circumferential direction of the cylinder, a cylindrical spiral duct is formed. When the spiral duct is formed to have a proper length, it is cut by a circular cutter.

In the process of manufacturing the spiral duct, the pressing rollers for bending both ends of the metal plate member, and the pressing rollers for pressing both ends of the metal plate member, are driven by a plurality of gears or chains.

Such a representative spiral duct manufacturing apparatus is disclosed in Korean Unexamined Utility Model No. 1999-5329 (hereinafter, referred to as "related art 1"). Referring to FIGS. 1A to 1E, the construction of the spiral duct manufacturing apparatus will be described.

As shown in FIGS. 1A to 1E, the spiral duct manufacturing apparatus according to the related art carries a metal plate member 18, supplied from a reel stand 19, through a plurality of bending rollers 21 arranged in a plurality of lines so as to bend both ends of the metal plate member 18. Then, both ends of the metal plate member 18 are pressed by pressing rollers 31 so as to form a cylindrical duct, and the duct is cut by a circular saw blade 42. At the exit side of the bending rollers 21, a transfer unit 2 including a pair of driving rollers 22 is installed on a first table 11. The driving rollers 22 are composed of a lower driving roller 24 which is connected to a cylinder 25 so as to operate in the vertical direction, and an upper driving roller 23 which is disposed above the lower driving roller 24 and receives power from a driving motor 26.

On a second table 12, a forming unit 3 is installed, including a bolt 32 which adjusts a pressing force for coupling the bent portions 18*a* and 18*b* of the metal plate member 18 supplied from the transfer unit 2, a pair of pressing rollers 31 to which the distal end of a lever 33 having the bolt 32 fastened thereto is coupled, and a circular frame 34 which guides a duct which is formed in a cylinder shape while passing through the pressing rollers 31.

The circular frame 34 has a spiral guide groove 35 formed on the inner circumferential surface thereof, the spiral guide groove 35 serving to guide the duct.

Under the forming unit 3, a cutting unit 4 is installed on the second table 12.

The cutting unit 4 includes an operating plate 41 which slides on the second table 12, a bracket 46 which is installed on the distal end of the operating plate 41 so as to connect the circular saw blade 42, a motor 43 for rotating the circular saw blade 42, and a cylinder 44 which adjusts the height of the circular saw blade 42.

On the second table 12, a cylinder 47 for moving and returning the cutting unit 4 is installed. The first and second tables 11 and 12 are connected through a guide plate 5.

The spiral duct manufacturing apparatus according to the related art winds a metal band, supplied at an oblique angle, into a cylindrical shape, thereby manufacturing a spiral duct.

The spiral duct manufacturing apparatus can manufacture a spiral duct formed in a straight line, but cannot manufacture a spiral duct having an elbow which is bent at a predetermined angle depending on a place where the spiral duct is installed.

Further, a spiral duct manufacturing apparatus and method is disclosed in Korean Patent Laid-open Publication No. 2006-28859 (hereinafter, referred to "related art 2") filed by the present applicant. FIGS. 2 A and 2B show the spiral duct manufacturing apparatus.

As shown in FIGS. 2 A and 2B, the spiral duct manufacturing apparatus according to related art 2 includes a first edge forming roll 10 for forming a double folded portion 31 on both edges of a metal band 30, a cutting roll 20 whose horizontal rotation angle periodically varies so as to cut the metal band 30 supplied from the first edge forming roll 10 into a wave or straight line shape along the longitudinal direction, and a seaming device 50 which winds the cut metal band 30 into a spiral shape while coupling a single folded portion 32 to a double folded portion 31.

The spiral duct manufacturing apparatus can manufacture not only a straight spiral duct but also a spiral duct having an elbow. Since the elbow is formed in such a manner that the outer circumference thereof is set in a straight line, the elbow is not formed in a gently curved line, but in a straight line which is bent several times at various angles.

DISCLOSURE

Technical Problem

In order to solve the foregoing and/or other problems, it is an objective of the present invention to provide a manufacturing apparatus and method of a spiral duct including an elbow that manufacture a duct and an elbow for connecting a duct to another duct.

It is an objective of the present invention to provide a manufacturing apparatus and method of a spiral duct including an elbow that cut a metal plate member wound around a reel into a wave shape and bend the projecting wave portions of the metal plate member to manufacture a spiral duct having an elbow.

Technical Solution

In one aspect, the invention is directed to a manufacturing apparatus of a spiral duct including an elbow, comprising: a wave bending unit that upwardly bends projecting wave portions of metal plate members supplied in a state where the metal plate members are cut in such a manner that a straight line and waves are formed; a transfer unit that transfer the metal plate members having the bent wave portions; and a forming and cutting unit that forms the metal plate members transferred from the transfer unit into a cylindrical spiral shape, presses the metal plate members to form an elbow, and then cuts the metal plate members.

In another aspect, the invention is directed to a manufacturing method of a spiral duct including an elbow, comprising: bending projecting wave portions of metal plate members upward by a ball caster, the metal plate members being cut in such a manner that a straight lines and waves are formed; transferring the metal plate members using a pair of transfer rollers which are rotated by a first motor installed in a manufacturing apparatus of a spiral duct including an elbow; pressing a single folded portion and a double folded portion of the metal plate members using upper and lower pressing rollers while the transferred metal plate members are rolled into a circular shape by a joint jig; and cutting the elbow formed by the manufacturing apparatus using upper and lower cutters.

DESCRIPTION OF DRAWINGS

The foregoing and other objects, features and advantages of the invention will be more apparent from the more particular description of preferred embodiments of the invention, as illustrated in the accompanying drawings. The drawings are not necessarily to scale, emphasis instead being placed upon illustrating principles of the invention.

FIG. 3 B is a plan view of the manufacturing apparatus of a spiral duct including an elbow according to the present invention.

MODE FOR INVENTION

Hereinafter, exemplary embodiments of the present invention will be described with reference to the accompanying drawings.

Figure 1A:
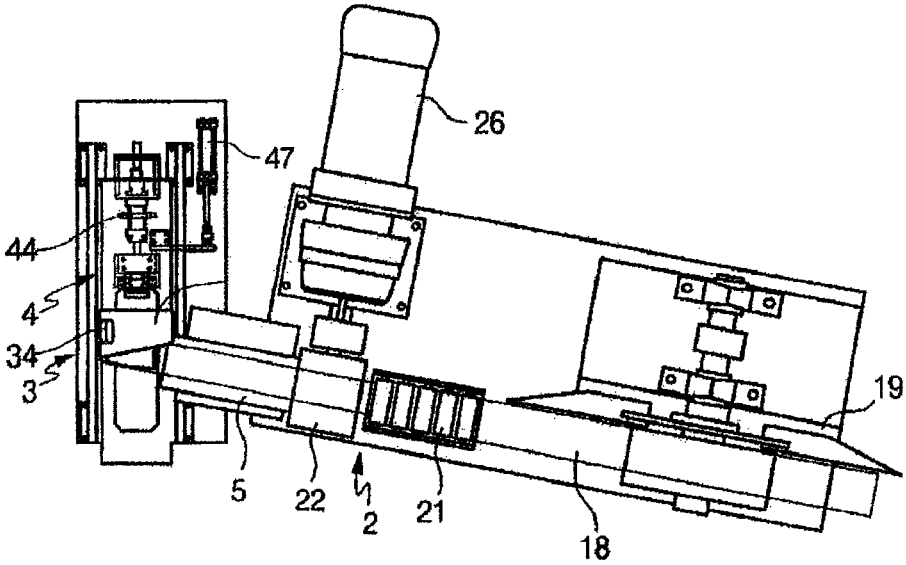
FIG. 1A is a plan cross-sectional view of a conventional spiral duct manufacturing apparatus.
Figure 1B:
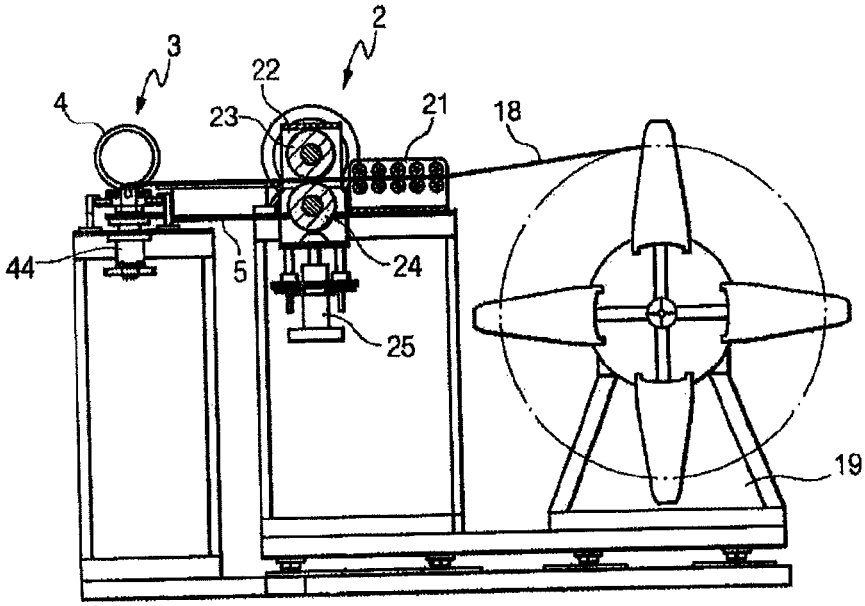
FIG. 1B is a front view of the spiral duct manufacturing apparatus which is partially cut.
Figure 1C:
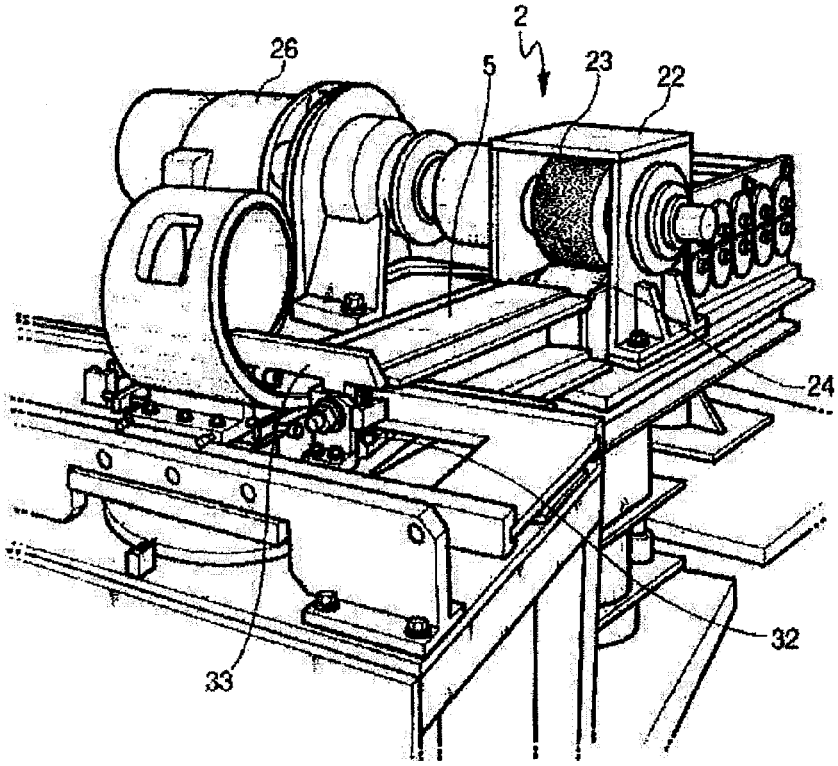
FIG. 1C is a perspective view of a forming unit.
Figure 1D:
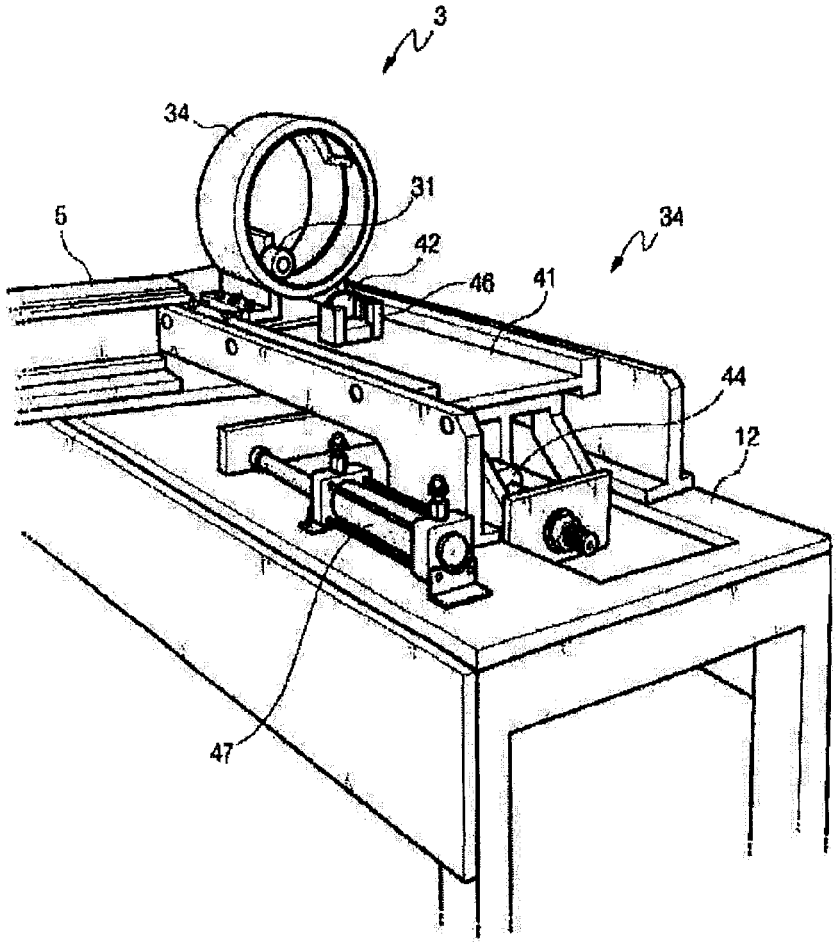
FIG. 1D is a perspective view of a cutting unit.
Figure 1E:
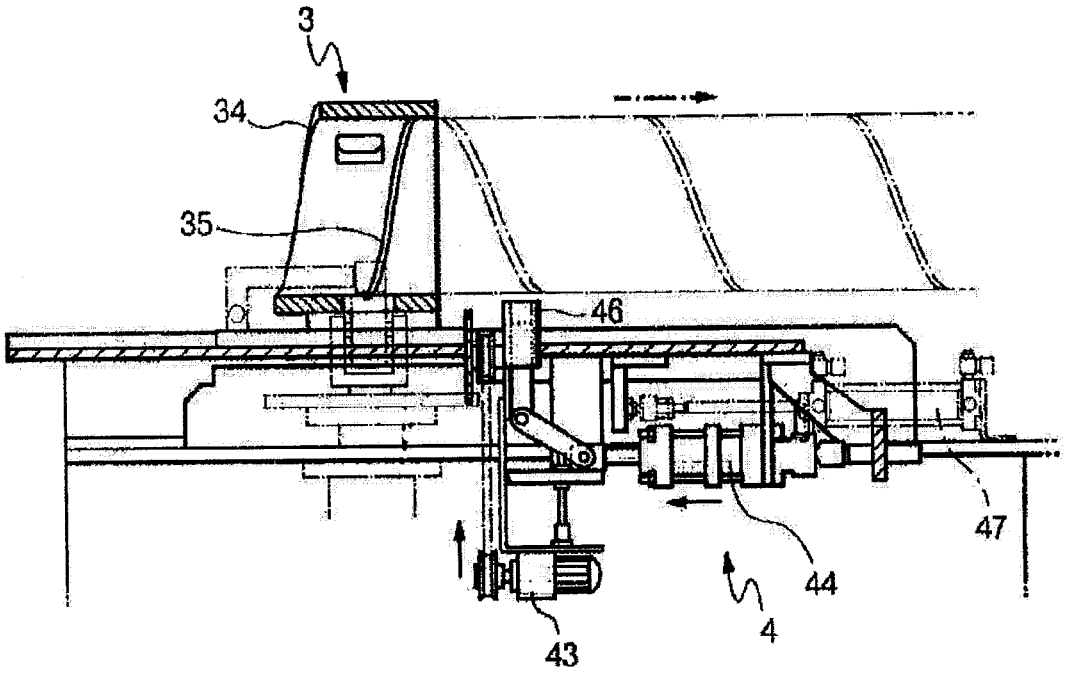
FIG. 1E is a side view illustrating an operation state.
Figure 2A:
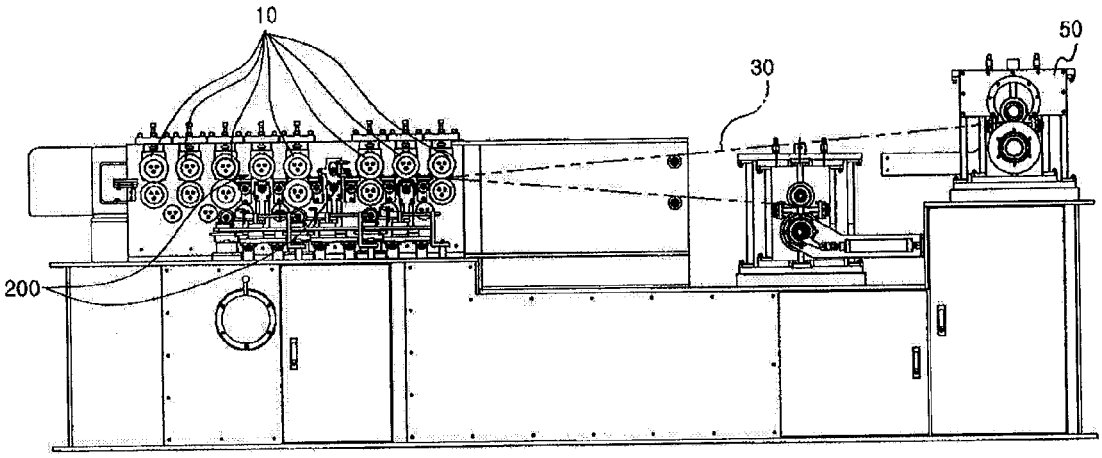
FIG. 2A is a side view of a spiral duct manufacturing apparatus filed by the present applicant.
Figure 2B:
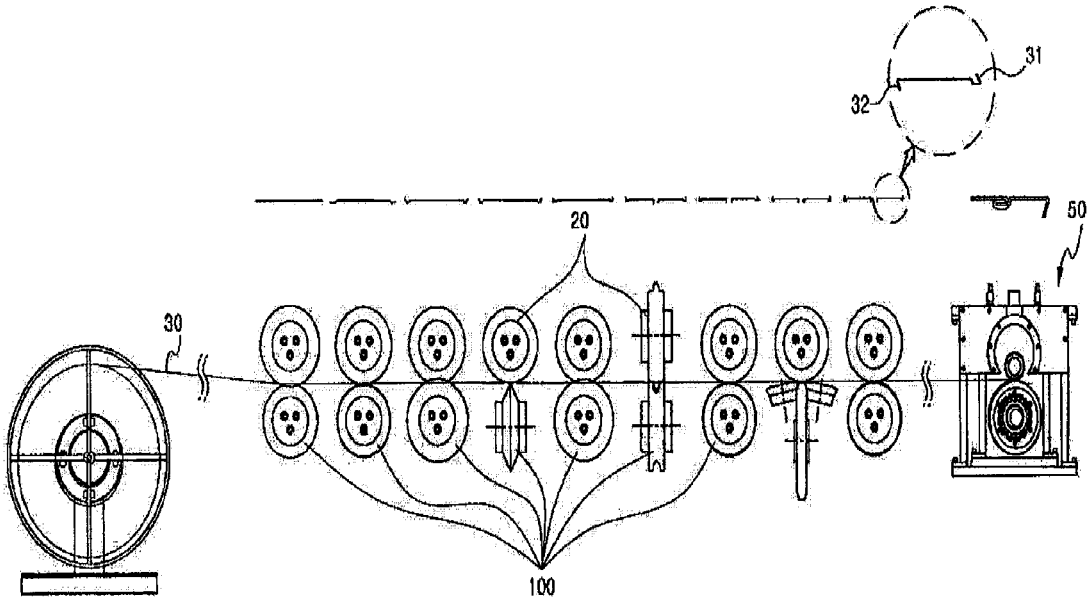
FIG. 2B is a side view of a spiral duct manufacturing apparatus filed by the present applicant.
Figure 3A:
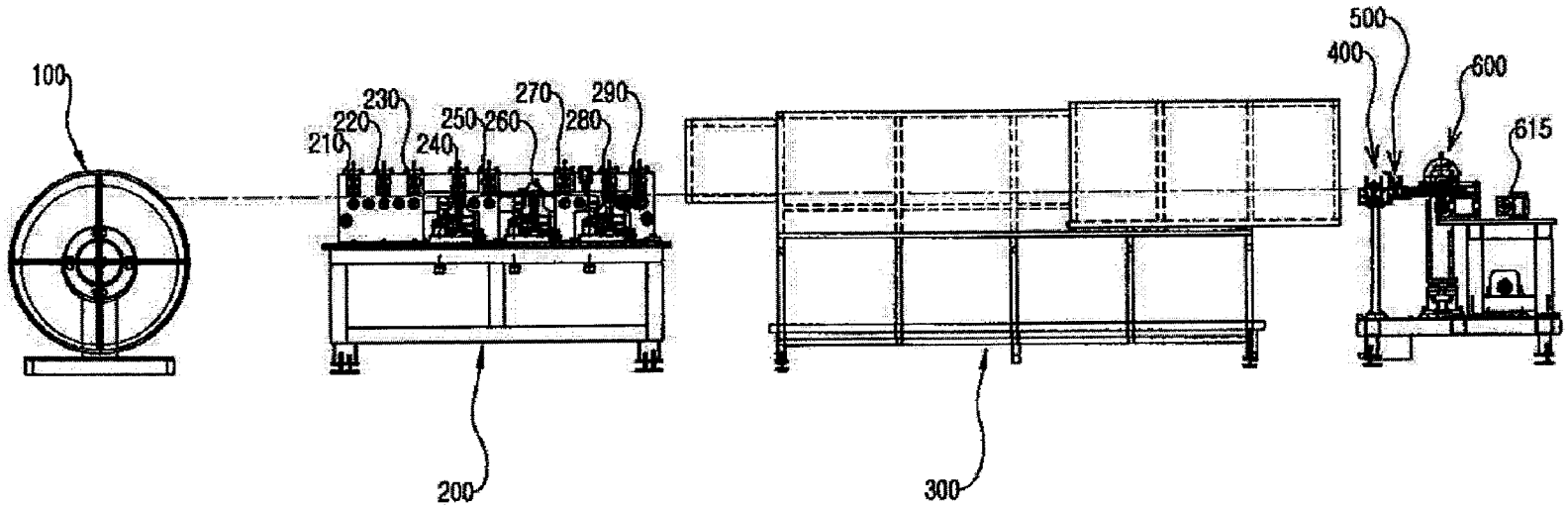
FIG. 3 A is a front view of a manufacturing apparatus of a spiral duct including an elbow according to the present invention.
Figure 3B:
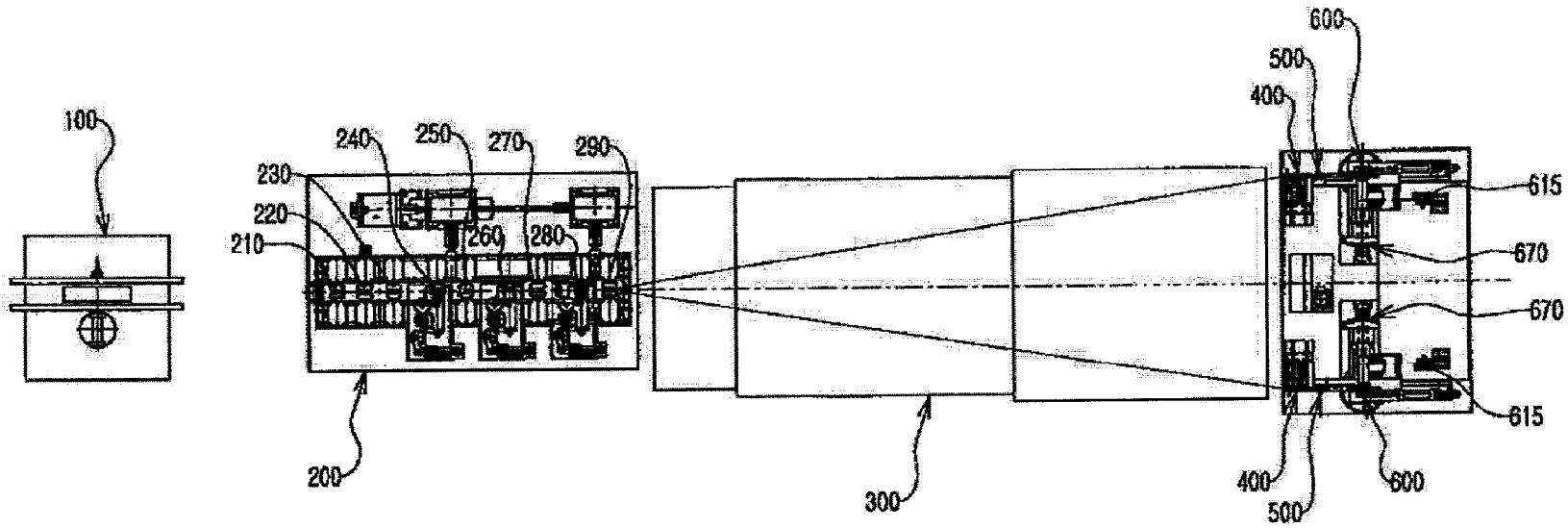
Figure 7:
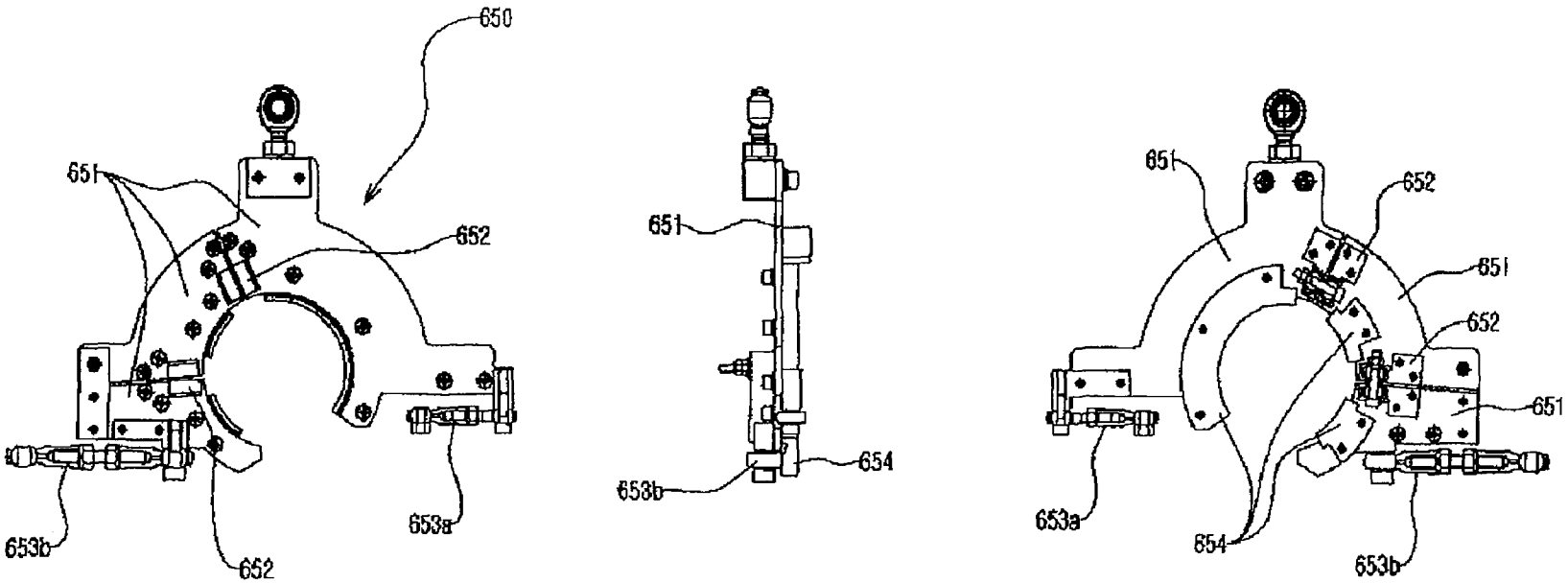
FIG. 7 is a front view and a side view of a joint jig according to the present invention.
Figure 8A:
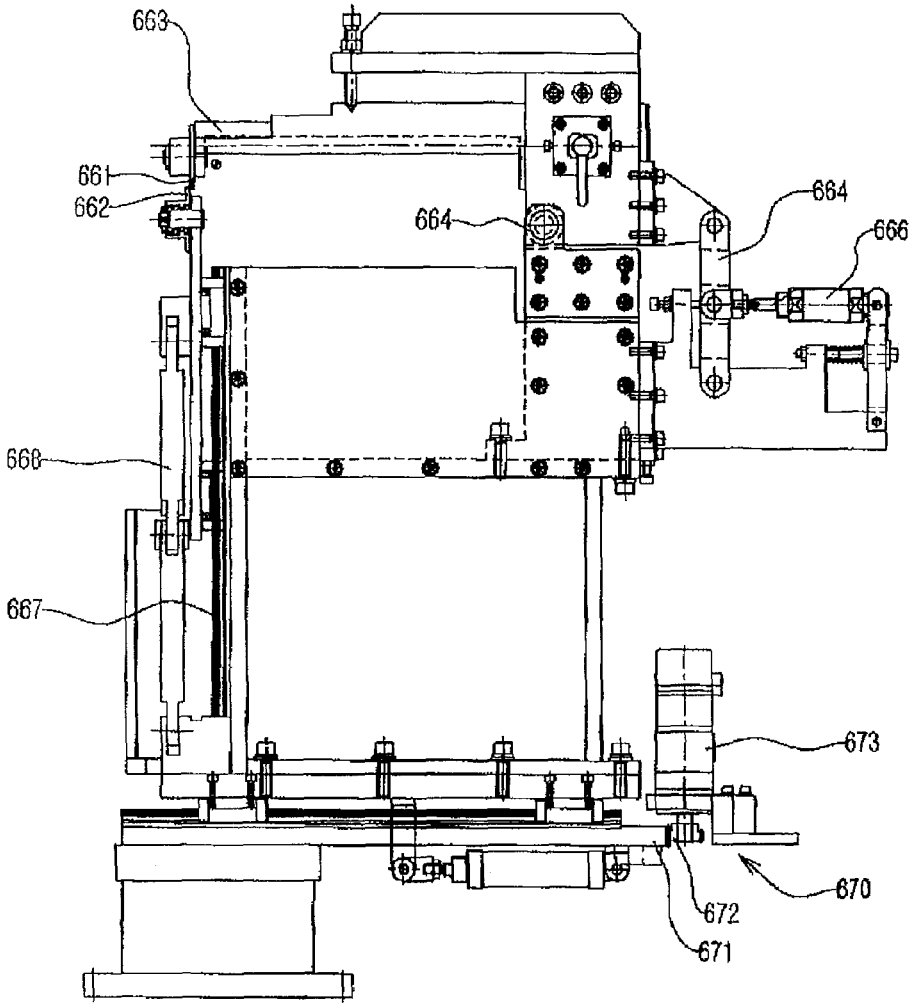
FIG. 8A is a front view of a forming and cutting unit of a manufacturing apparatus of a spiral duct including an elbow according to the present invention.
Figure 8B:
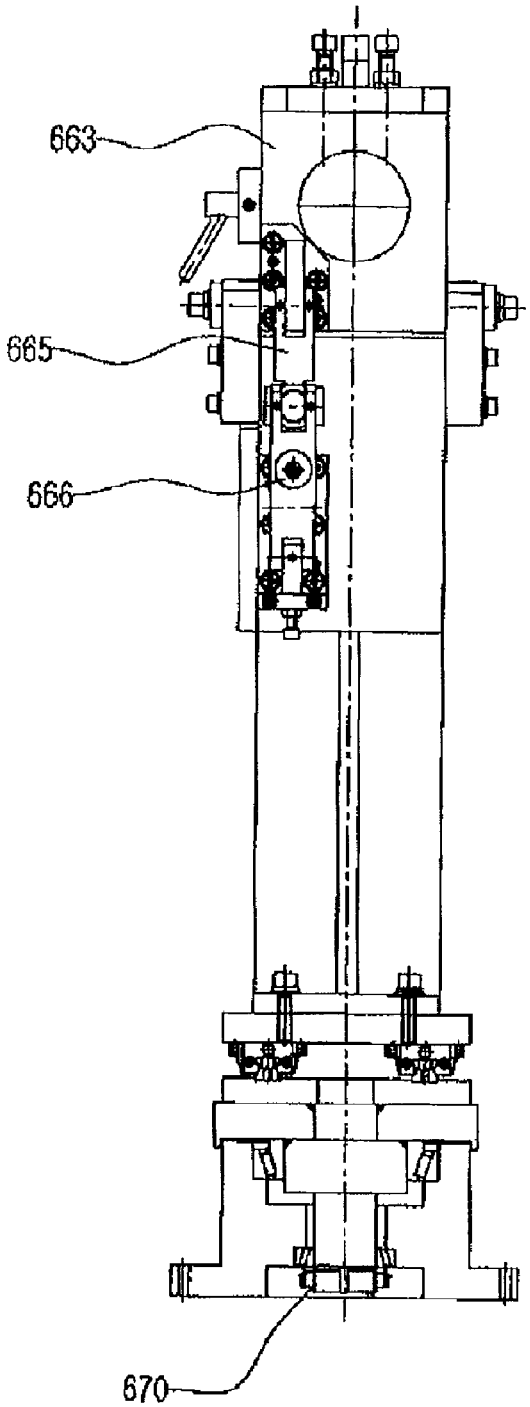
FIG. 8B is a right side view of FIG. 8 A.
Figure 8C:
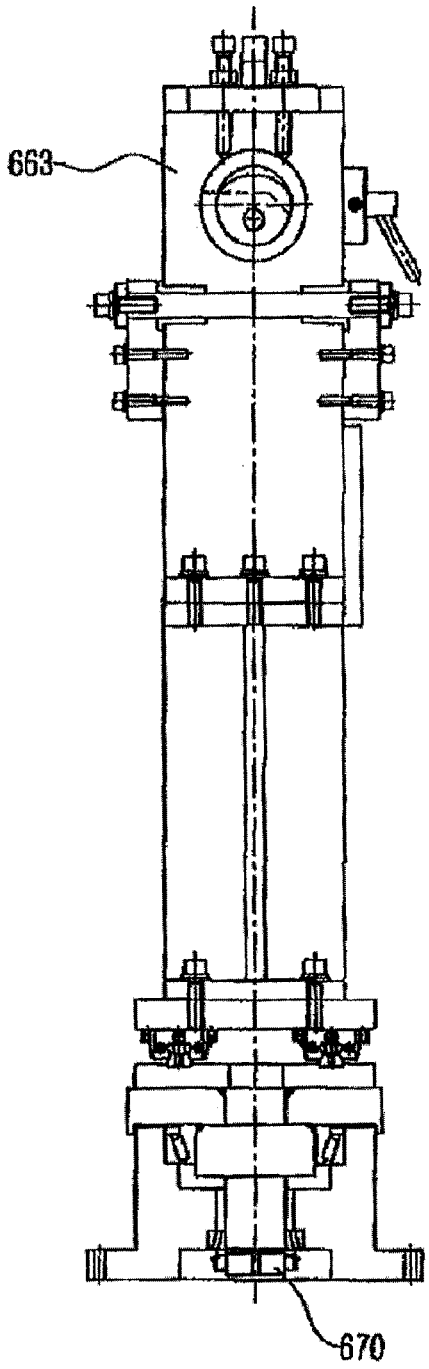
FIG. 8C is a side cross-sectional view of FIG. 8 A.
Figure 9:
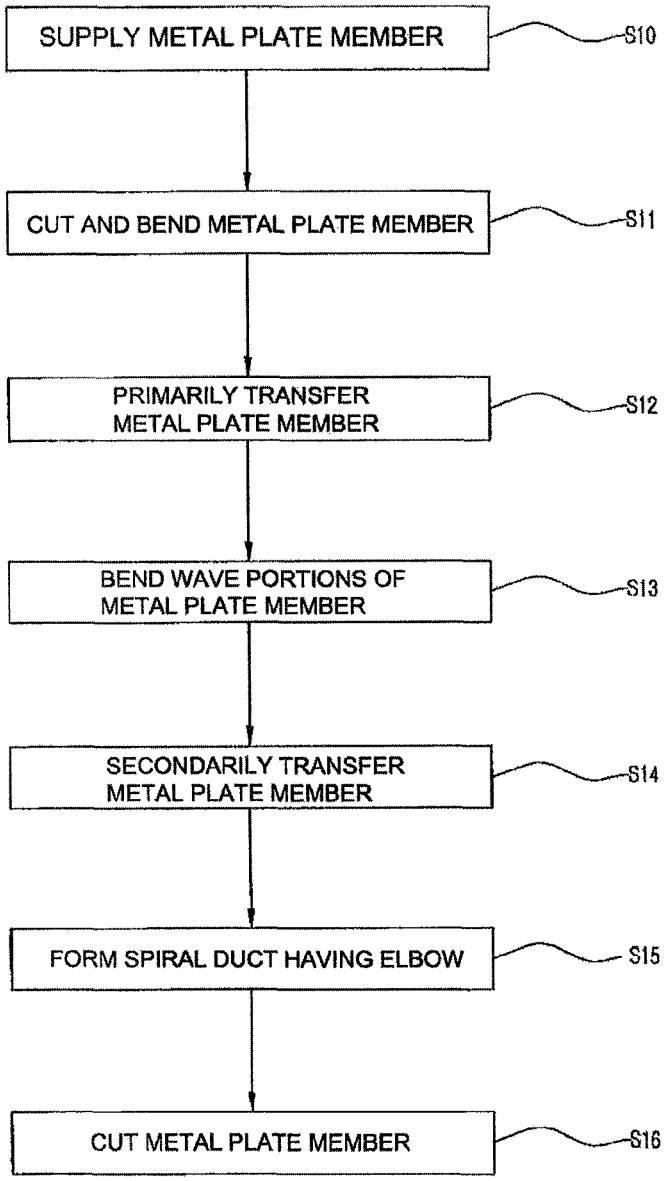
FIG. 9 is a flowchart sequentially showing a manufacturing method of a spiral duct including an elbow according to the present invention.

FIG. 3 A is a front view of a manufacturing apparatus of a spiral duct including an elbow according to the present invention. FIG. 3B is a plan view of the manufacturing apparatus of a spiral duct including an elbow according to the present invention. FIGS. 4 A to 4D are diagrams showing the manufacturing apparatus according to the present invention. FIGS. 5 A to 5F are diagrams showing a wave bending unit of the present invention. FIGS. 6 A to 6H are diagrams showing a forming and cutting unit of the present invention. FIG. 7 is a diagram showing the essential parts of a fixing device which fixes a joint jig of the present invention. FIGS. 8 A to 8 C are front and side views of the joint jig according to the present invention. FIG. 9 is a flowchart sequentially showing a manufacturing method of a spiral duct including an elbow according to the present invention. As shown in FIGS. 3 to 8, the manufacturing apparatus according to the present invention includes an uncoiler 100 which supplies a metal plate member with a predetermined width, a wave cutting unit 200 which cuts the supplied metal plate member into a wave shape, a first transfer unit 300 which transfers the metal plate member from the wave cutting unit 200, a wave bending unit 400 which bends the projecting wave portions of the transferred metal plate members upward, a second transfer unit 500 which pulls the bent metal plate member, and a forming and cutting unit 600 which forms the metal plate member, transferred by the second transfer unit 500, into an elbow and then cuts the metal plate member.

Around the uncoiler 100, the metal plate member for forming a spiral duct is wound. As shown in FIGS. 3A and 3B, the metal plate member is installed in such a manner that the wave bending unit 400, the second transfer unit 500, and the forming and cutting unit 600 are symmetrically provided. The manufacturing apparatus forms two metal plate members, cut by the wave cutting unit 200, into elbows. Two metal plate members cut in the longitudinal direction are simultaneously formed into elbows, respectively.

Since the wave cutting unit 200 is disclosed in Korean Patent Application No. 2006-28859, filed by the present applicant, it will only be briefly described here. The wave cutting unit 200 includes a first edge forming roll. The first edge forming roll includes a first inclination forming roll 210 which flattens the metal plate member supplied from the uncoiler 100, a second inclination forming roll 220 which slightly bends the edge of the metal plate member downward, and a third inclination forming roll 230 which bends the downward-bent edge of the metal plate member upward so as to form a double folded portion.

The wave cutting unit 200 includes a line scribing roll 240 which scribes a wave-shaped line on the metal plate member and a vertical forming roll 250 which vertically forms the inclined edge of the metal plate member.

Further, the wave cutting unit 200 includes a partitioning roll 260 which cuts the metal plate member along the longitudinal direction into two parts, and an inward inclination forming roll 270 which bends the vertically-erected edge of the metal plate member inward. The partitioning roll 260 forms an L-shaped single folded portion on the edge of the metal plate member while cutting the metal plate member into a wave shape.

The wave cutting unit 200 includes a second edge forming roll 280 which bends the edges of the wave-shaped portions of the metal plate members so as to form a single folded portion, and a guide roll 290 which guides and discharges two of the metal plate members. Next to the wave cutting unit 200, the first transfer unit 300 formed of a conveyor is installed so as to stably transfer the cut metal plate members.

The manufacturing apparatus according to the present invention includes the wave bending unit 400, the second transfer unit 500, and the forming and cutting unit 600. As shown in FIG. 3B, the wave bending unit 400, the second transfer unit 500, and the forming and cutting unit 600 are symmetrically installed in the front and back direction. The symmetrical counterparts are denoted by the same names and reference numerals and only one of each will be described.

As shown in FIGS. 4 and 5, the wave bending unit 400 includes a detection sensor 410 which detects portions of the metal plate members, where the wave portions begin, which are transferred in a state where they are separated from each other. The detection sensor 410 is elastically installed to retreat and advance along the wave portions by a spring 411.

The wave bending unit 400 includes a ball caster 420 which partially bends the projecting wave portions of the separated metal plate members into a round shape. The ball caster 420 is installed so as to be moved by a linear guide 421, as shown in FIGS. 4 and 5.

The ball caster 420 is composed of an upper ball caster 422 and a lower ball caster 423. As shown in FIGS. 5C to 5F, the lower ball caster 423 is installed to retreat toward the linear guide 421 by the wave portions of the cut metal plate members. Between the lower ball caster 423 and the linear guide 421, an upwardly inclined plate 424 is installed. At one side of the lower ball caster 423, a cam 425 is movably installed to be lifted and lowered along the inclined surface 424.

Next to the ball caster 420, the second transfer unit 500 is installed to pull and transfer the metal plate members.

As shown in FIGS. 4 and 5, the second transfer unit 500 includes a first motor 510 which is driven by applied power, and a pair of transfer rollers 530 which are connected through a universal joint 520 to be rotated.

The transfer rollers 530 of the second transfer unit 500 are installed in such a manner that the height thereof is adjusted depending on the thickness of the supplied metal plate members or the supply height of the metal plate members. On the top surface of an upper frame 531, a first adjusting lever 532 for adjusting the height of the transfer rollers 530 is installed.

Figure 4A:
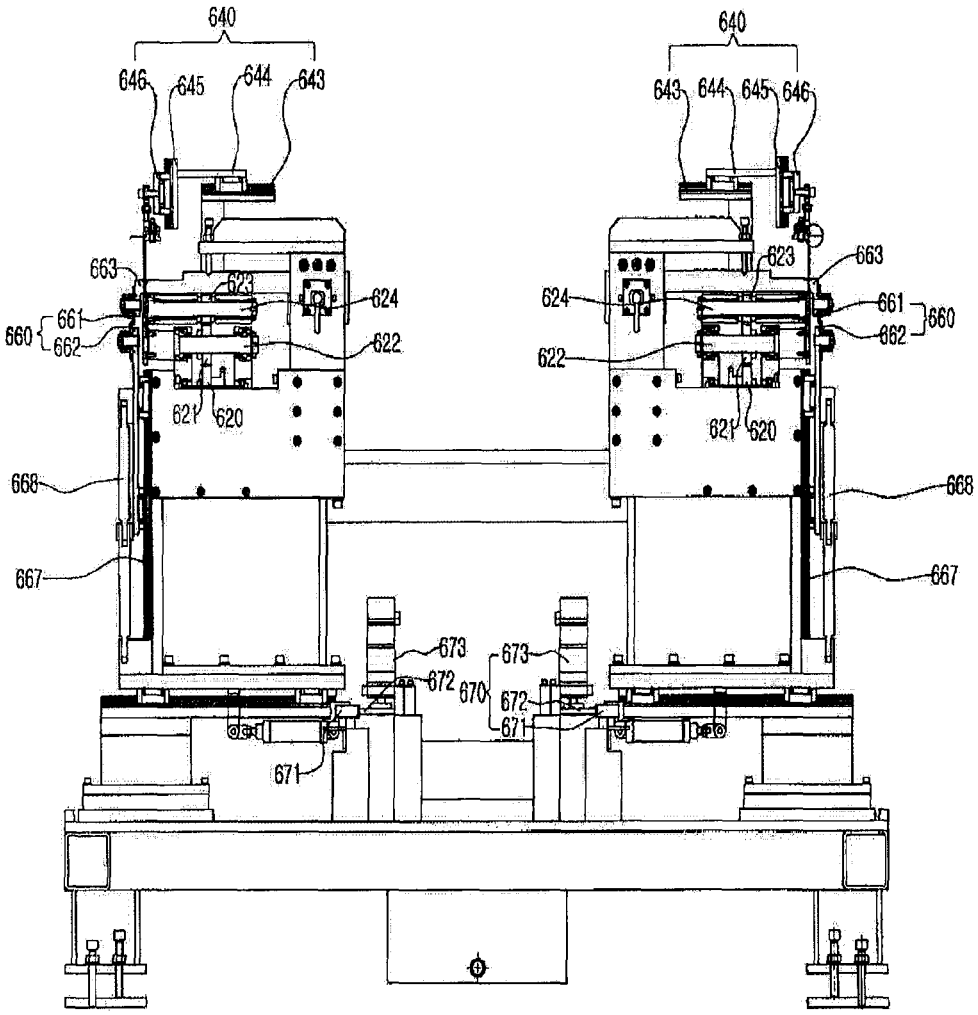
FIG. 4A is a front view of a manufacturing apparatus of a spiral duct including an elbow according to the present invention.
Figure 4B:
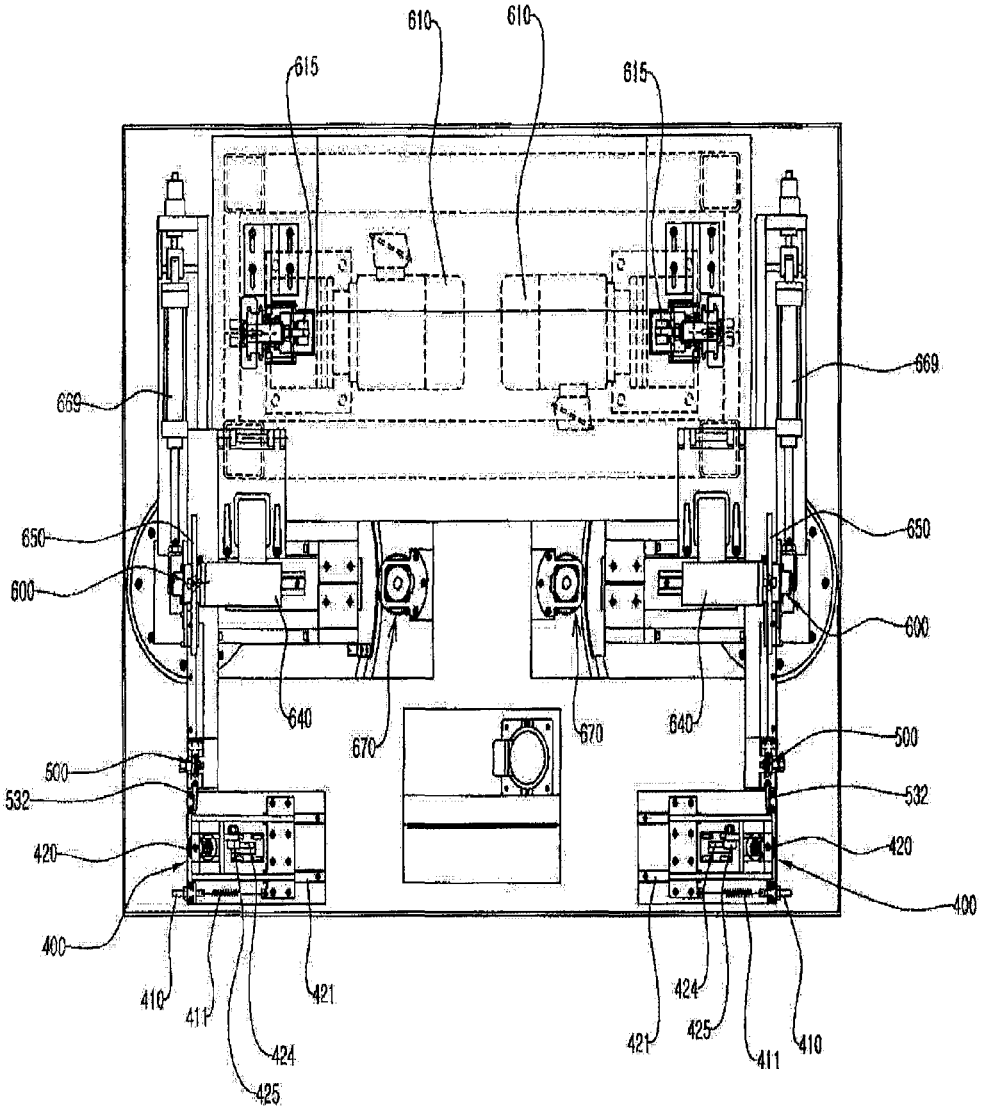
FIG. 4B is a plan view of the manufacturing apparatus of FIG. 4 A.
Figure 4C:
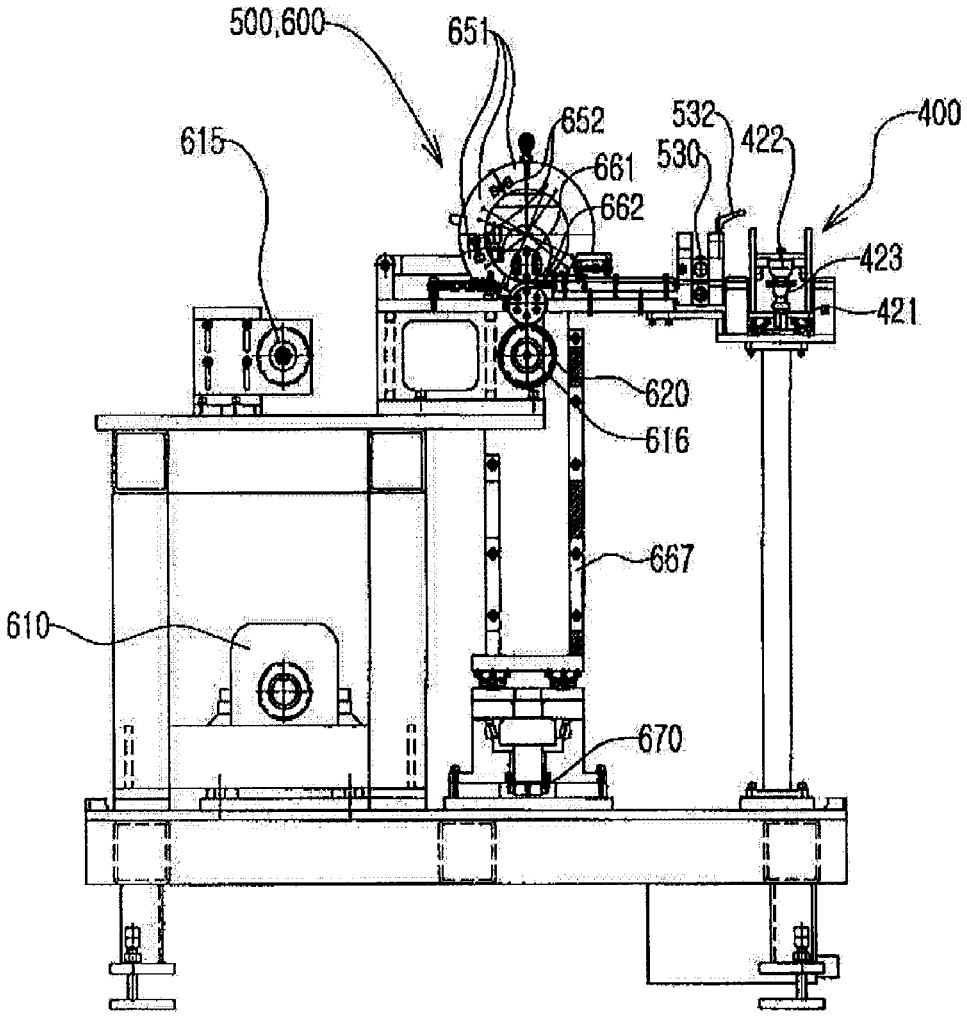
FIG. 4C is a side view of the manufacturing apparatus of FIG. 4 A.
Figure 4D:
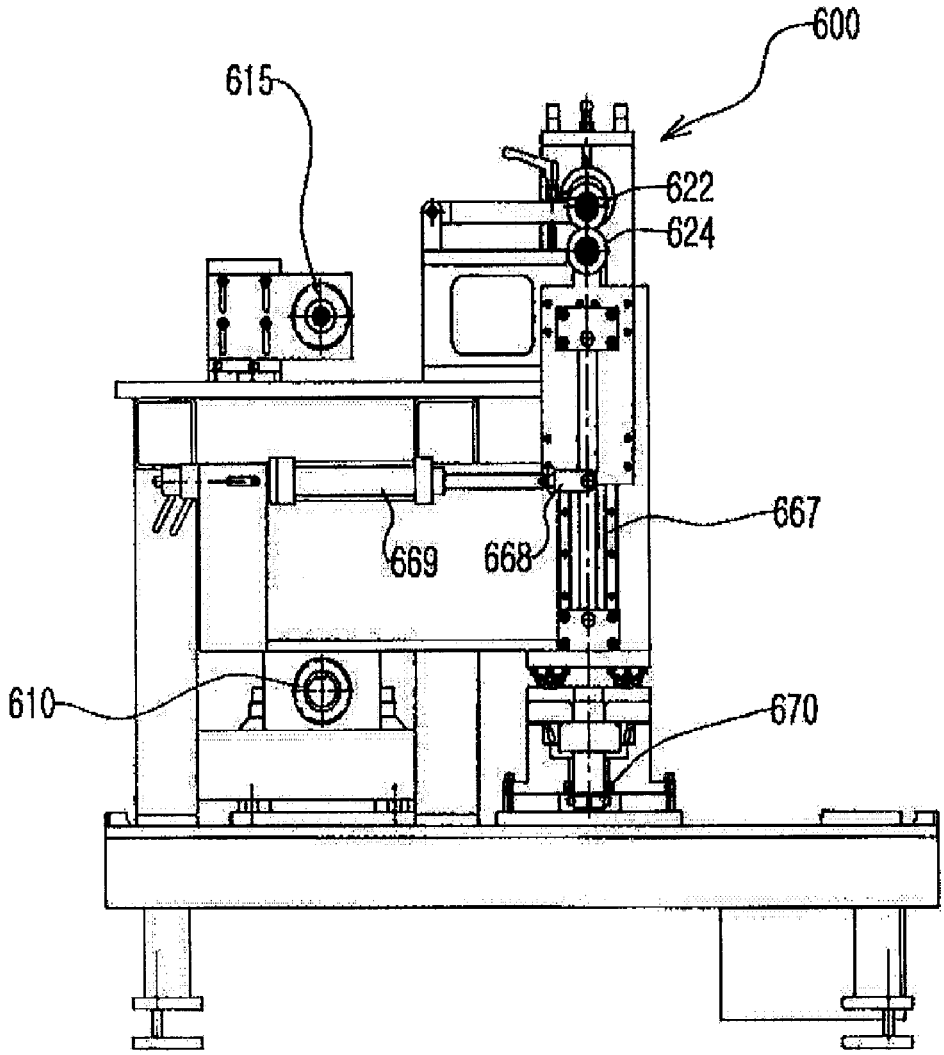
FIG. 4D is a side cross-sectional view of the manufacturing apparatus of FIG. 4A.

The forming and cutting unit 600 forms the metal plate members, which are supplied in a state where both sides thereof are bent, into cylindrical spiral elbows and cuts the formed elbows. As shown in FIGS. 4C and 4D, the forming and cutting unit 600 includes a second driving motor 610 for generating power, and an encoder 615 which is formed above the second driving motor 610 and measures the length of the supplied metal plate members while transmitting a rotating force. The second driving motor 610 and the encoder 615 are connected to a power transmission unit in which a sprocket is connected through a chain.

Further, as shown in FIGS. 4C, 5 A, and 6 A, the encoder 615 is connected to the power transmission unit composed of an idle sprocket 616 and a chain so as to transmit a rotating force. The sprocket 616 is formed integrally with a first gear 620 which transmits the rotating force.

As shown in FIG. 4 A, the first gear 620 is geared with a second gear 621, and the second gear 621 has a lower pressing roller 622 installed thereon, the lower pressing roller 621 pressing a connection portion of the spiral duct against the distal end of a shaft.

The second gear 621 is geared with a third gear 623 provided above the second gear 621. The third gear 623 has an upper pressing roller 624 installed thereon such that the upper pressing roller 624 is adjacent to the lower pressing roller 622, the upper pressing roller 624 pressing the connection portion of the spiral duct against the distal end of the shaft.

The lower and upper pressing rollers 622 and 624 serve to press the double folded portion and the single folded portion formed on the edge of the metal plate member, and the lower pressing roller 622 has a concave groove formed thereon.

As shown in FIGS. 4C and 7, the joint jig 650 and a fixing device 640 for fixing the joint jig 650 are installed above the upper and lower pressing rollers 622 and 624.

As shown in FIGS. 6A to 6H, the fixing device 640 includes a pedestal 641, a support 642 installed on the top surface of the pedestal 641, a horizontal guide rail 643 installed on the support 642, and a first moving portion 644 which is coupled to the guide rail 643 so as to horizontally move.

The first moving portion 644 has a vertical guide rail 645 erected on the distal end thereof, and a second moving portion 646 is coupled to the vertical guide rail 645 so as to vertically move. Under the vertical guide rail 645, the joint jig 650 is installed, which forms the supplied metal plate members into a cylindrical spiral shape.

As shown in FIG. 7, the joint jig 650 is formed in a circular arc shape of which a portion is opened, and is composed of a plurality of divided pieces 651. That is, the divided pieces 651 are coupled to each other so as to construct the joint jig 650. The divided pieces 651 are coupled through self-aligning bearings 652 so as to freely move. In this case, the divided pieces 651 respectively form circular arcs whose center angles are different from each other.

Further, cylinders 653*a* and 653*b* are installed in both sides of the divided pieces 651 such that the length of the divided pieces 651 is adjusted. Among the divided pieces 651, a divided piece positioned in the upper side is fixed to the second moving portion 646 coupled to the vertical guide rail 645 of the fixing device 640.

The cylinders 653*a* and 653*b* are coupled to self-aligning bearings.

The joint jig 650 has a moving plate 654 fixed to one surface thereof, and the moving plate 654 is bent toward the inner curve of the joint jig 650 such that the metal plate members are transferred in a state where they are held.

As shown in FIGS. 4 and 8, the manufacturing apparatus includes a cutter 660 provided on the front surface of the fixing device 640, the cutter 660 cutting the formed elbows. The cutter 660 is composed of upper and lower cutters 661 and 662.

As shown in FIG. 8, the upper and lower cutters 661 and 662 are installed so as to overlap each other. The upper cutter 661 is not only installed so as to project from the manufacturing apparatus, but is also installed so as to be lifted upward.

Therefore, the upper cutter 661 does not interfere with the formed elbows. That is, as shown in FIG. 8, the upper cutter 661 is installed at one side of a frame 663, and a bearing coupling-hinge shaft 664 is installed under the frame 663 so as to serve as a center point of rotation. At the other side of the frame 663, a link 665 is installed so as to rotate about one end thereof.

The link 665 has a first cylinder 666 installed thereon, the first cylinder 666 advancing and retreating the link 665.

The lower cutter 662 has a rail 667 which is vertically installed under the lower cutter 667. As shown in FIG. 4B, a link 668 for lifting and lowering the lower cutter 662 is installed at one side of the rail 667, and a second cylinder 669 for horizontally moving the link 668 is installed on the link 668. On the bottom surface of the frame 663, a rotating device 670 for rotating the frame 663 by a predetermined angle is installed. The rotating device 670 includes a driven gear 671 which is installed at one side of the bottom surface of the frame 663 and has saw teeth formed at a predetermined angle, a driving gear 672 geared with the driven gear 671, and a servo motor 673 which is installed above the driving gear 672 so as to rotate the driven gear 671.

Further, the manufacturing apparatus also include a controller which generally controls the elbow manufacturing apparatus so as to form the spiral duct.

In the manufacturing apparatus constructed in such a manner, the metal plate member wound around the uncoiler 100 is continuously supplied.

First, an operator manually fixes the metal plate member to the ball caster 420, the transfer rollers 530, and the joint jig 650 through the wave cutting unit 200 and the first transfer unit 300.

When installation of the metal plate member is completed by the operator, the metal plate member wound around the uncoiler 100 is pulled by the wave cutting unit 200 so as to be continuously supplied (step S1O).

Both edges of the metal plate member supplied to the wave cutting unit 200 are bent by the guide roll 290 installed in series from the first inclination forming roll 210, and the central portion thereof is cut into a wave shape. Further, the edges of two cut metal plate members are bent (step SI 1).

In this case, the metal plate member is cut into predetermined lengths of line and wave shapes depending on the size of an elbow which is to be manufactured by the elbow manufacturing apparatus. That is, the center of the metal plate member is cut into a straight line with a predetermined length, and the metal plate member is then cut into a continuous wave shape so as to be formed into a cylindrical spiral shape. The number of waves of the cut plate metal plate members is properly set by an equation established depending on the diameter and length of the elbow.

As shown in FIG. 3, two of the cut metal plate members are transferred from the guide roll 290 through the first transfer unit 300 formed of a guide conveyor to the forming and cutting unit 600 by the wave bending unit 400 and the transfer rollers 530 (step S 12).

Figure 5A:
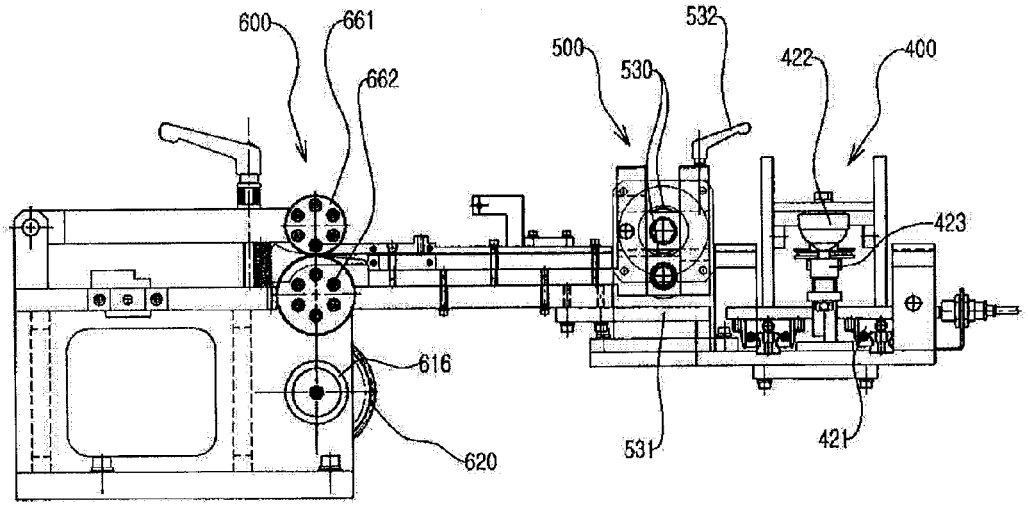
FIG. 5A is a front view of a wave bending unit according to the present invention.
Figure 5B:
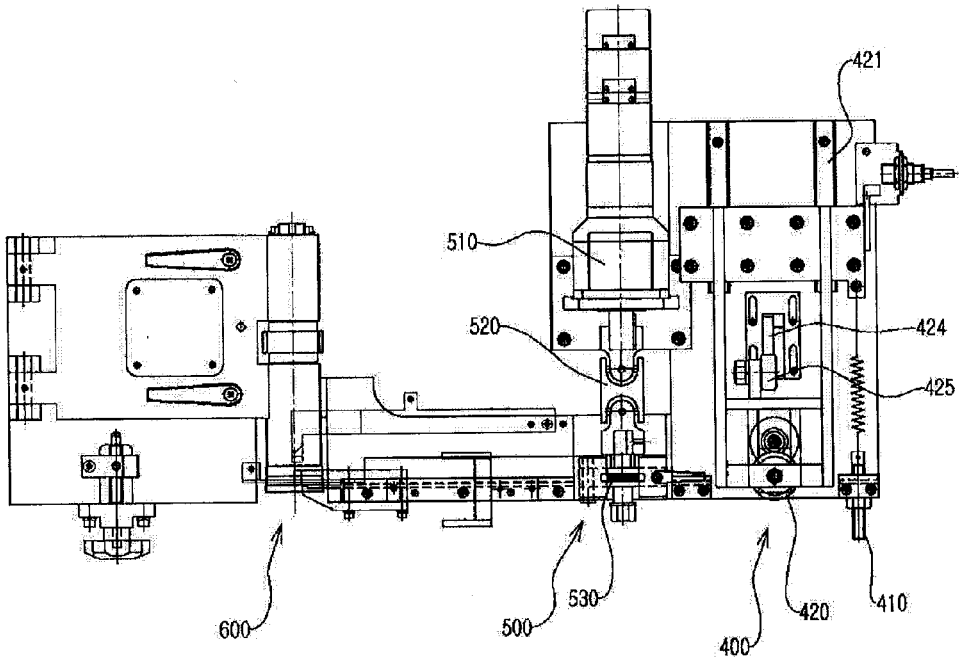
FIG. 5B is a plan view of the wave bending unit of FIG. 5 A.
Figure 5C:
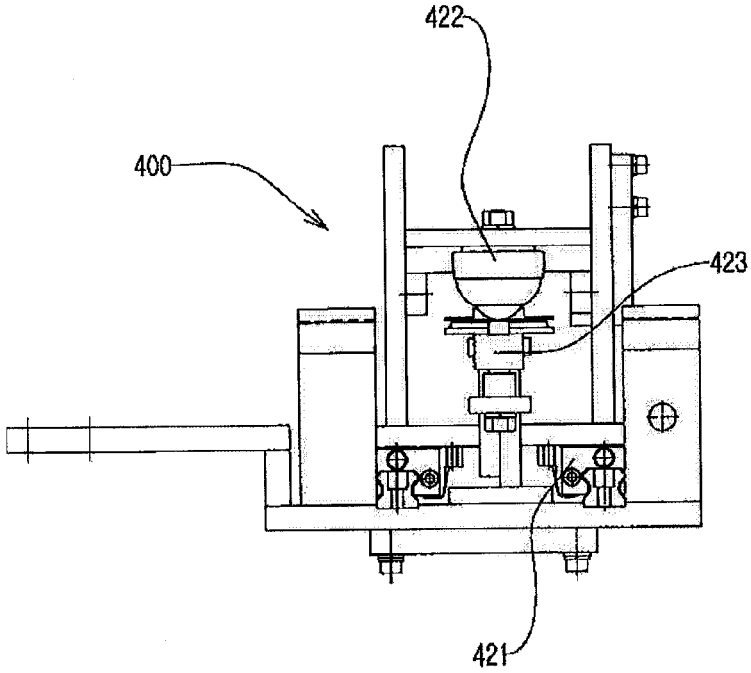
FIG. 5C is an enlarged view of a ball caster of the wave bending unit of FIG. 5A.
Figure 5D:
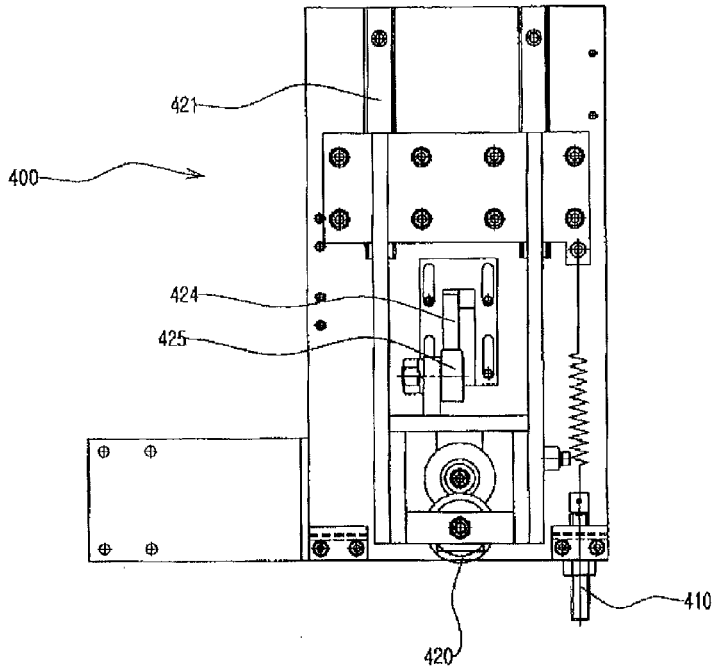
FIG. 5D is a plan view of FIG. 5C.
Figure 5E:
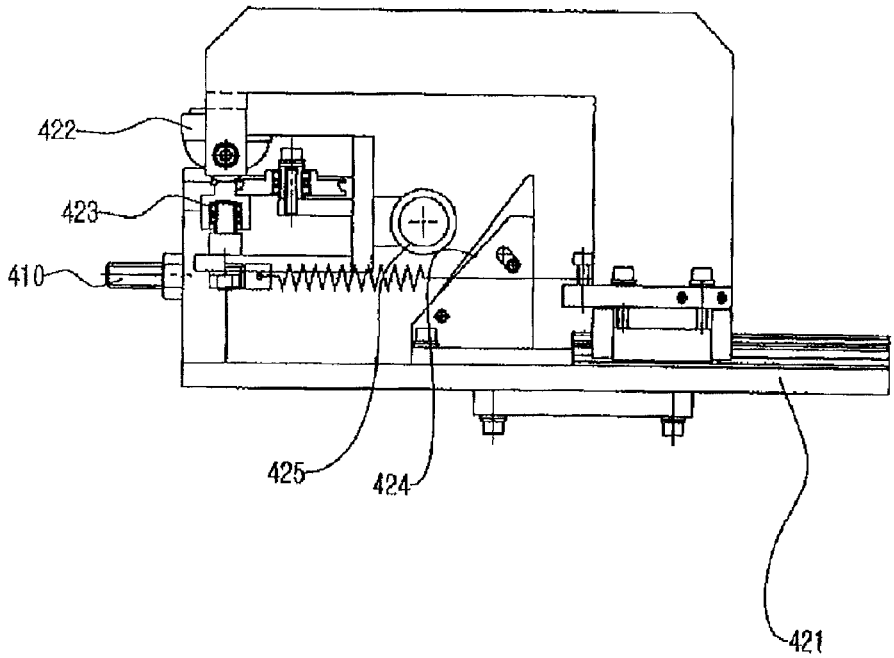
FIG. 5E is a side cross-sectional view of FIG. 5D.
Figure 5F:
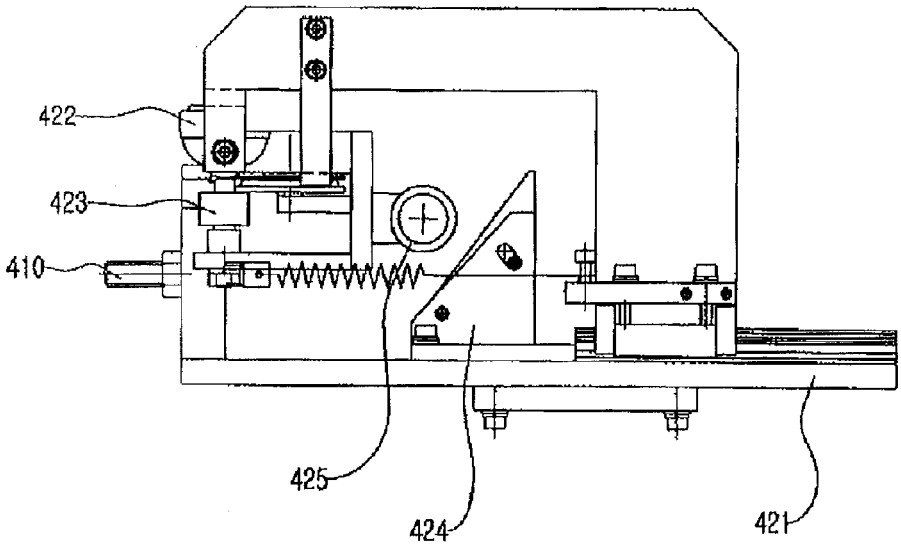
FIG. 5F is a side view of FIG. 5D.
Figure 6A:
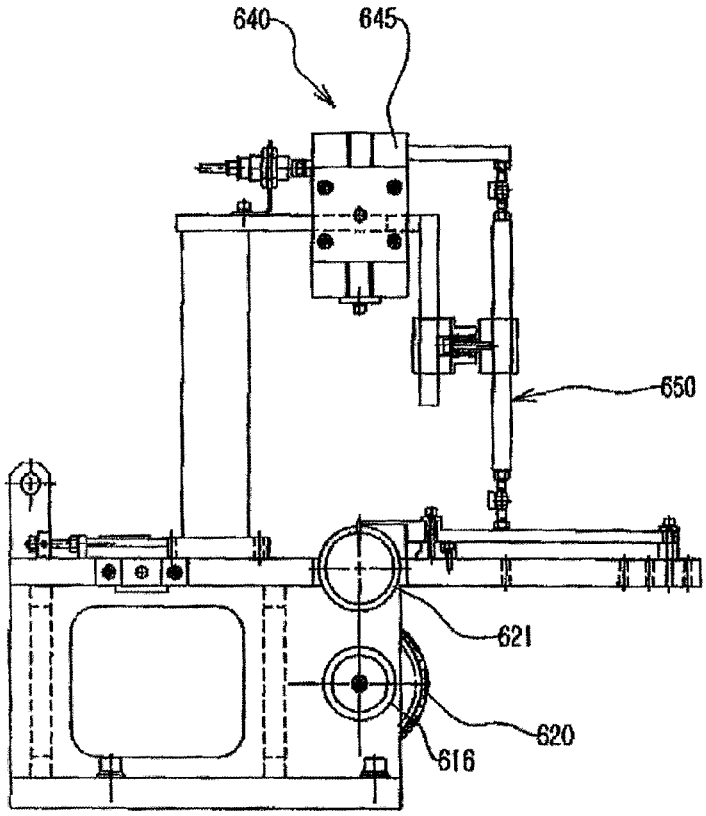
FIG. 6 A is a front view of a forming and cutting unit according to the present invention.
FIG. 6B is a plan view of FIG. 6A.
FIG. 6C is a side view of FIG. 6B.
FIG. 6D is a side cross-sectional view of FIG. 6B.
FIG. 6E is a front view of an essential part of a fixing device that fixes a joint jig according to the present invention.
FIG. 6F is a plan view of FIG. 6E.
FIG. 6G is a right side view of FIG. 6E.
FIG. 6H is a left side view of FIG. 6E.
Figure 6B:
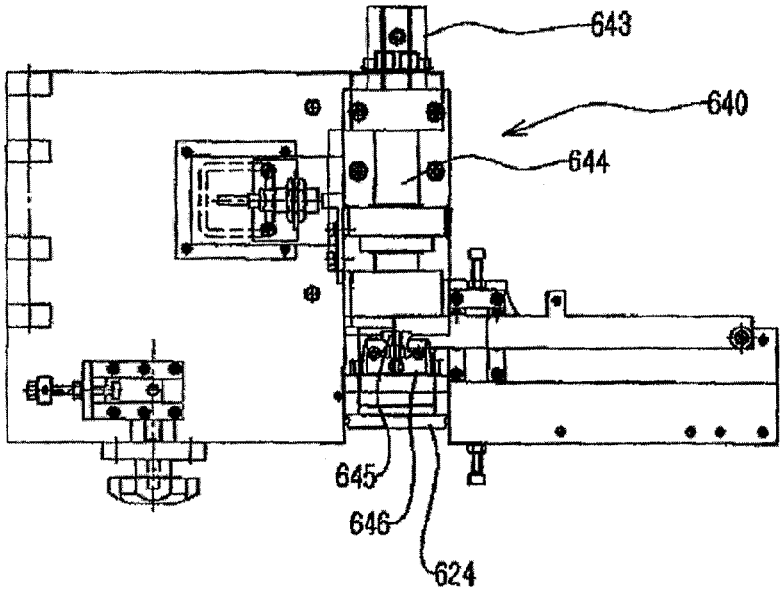
Figure 6C:
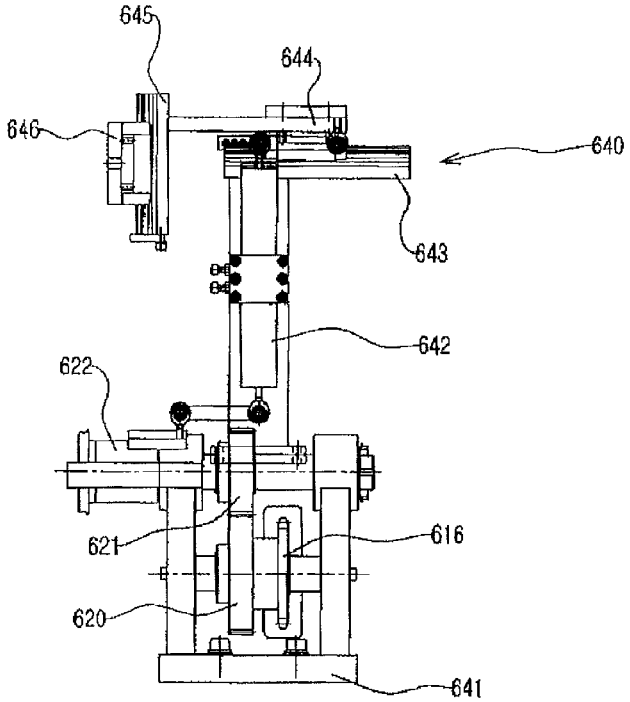
Figure 6D:
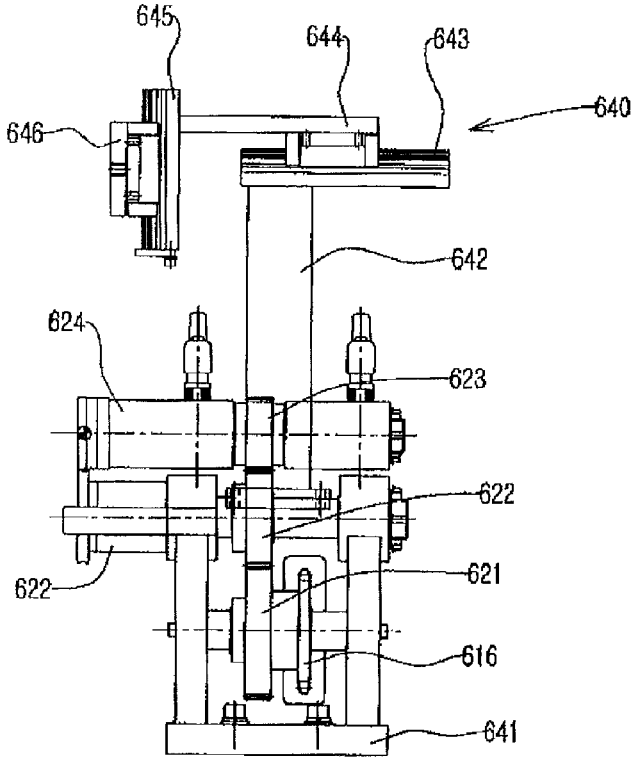
Figure 6E:
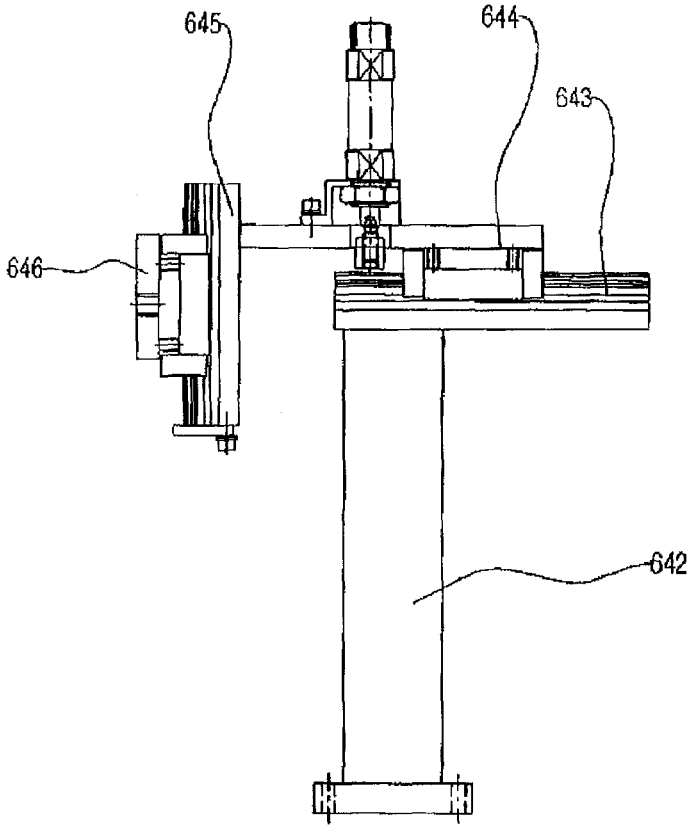
Figure 6F:
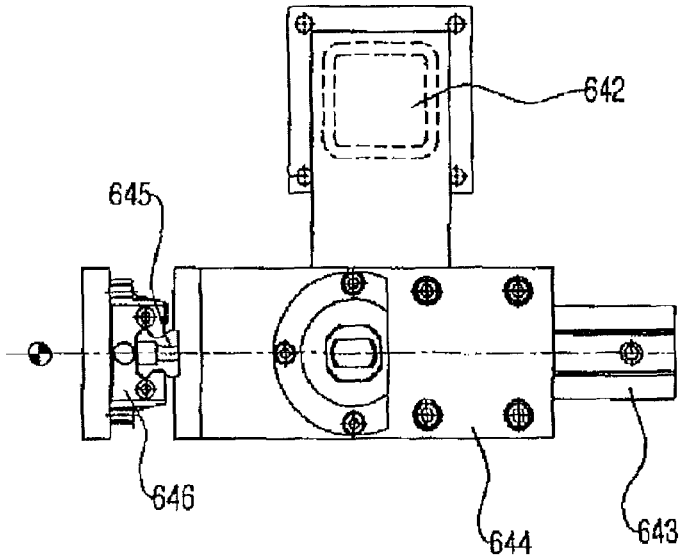
Figure 6G:
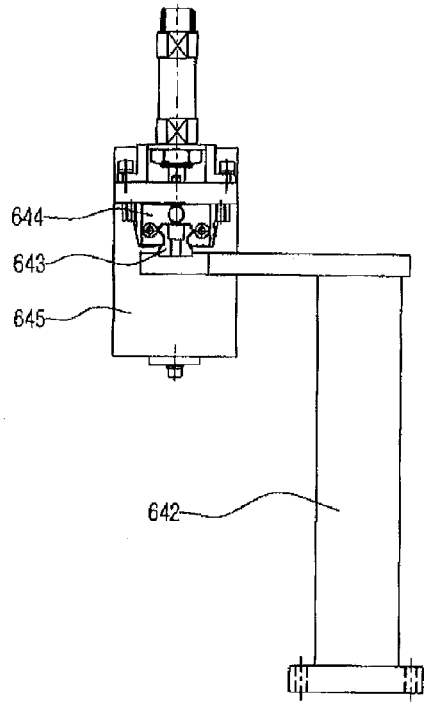
Figure 6H:
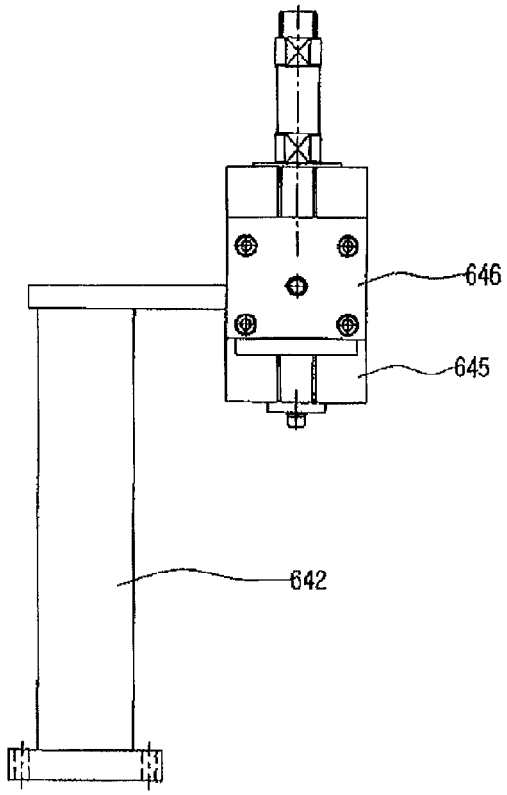

The detection sensor 410 installed in the wave bending unit 400 detects from the straightly-cut metal plate members that the wave-cut portions of the metal plate members enter. That is, the detection sensor 410 detects that the wave-cut portions of the metal plate members enter and then sends a detection signal to the encoder 615, and the encoder 615 accurately measures the length of the transferred metal plate members. Next, the metal plate members are supplied to the ball caster 420 of the wave bending unit 400. In this case, the straightly-cut portions of the metal plate members pass through the ball caster 420 as is. When the wave-cut portions of the metal plate members are supplied, the cam 425 is retreated by the projecting wave-cut portions of the metal plate members, as shown in FIG. 5E.

The retreated cam 425 is lifted along an inclined plate 425 installed at the right side of the drawing. Since the retreated state of the cam 425 is maintained until the projecting wave-cut portions of the metal plate members pass, the wave-cut portions of the metal plate members are bent upward in a state where the lower ball caster 423 is lifted.

When the wave-cut portions of the metal plate members pass, the cam 425 is lowered along the inclined plate 425, and the lowered state of the cam 425 is maintained at the straightly-cut portions of the metal plate members. Therefore, only the projecting wave-cut portions of the metal plate members are bent upward.

When the projecting wave-cut portions of the metal plate members enter, the cam 425 is lifted along the inclined plate 424 such that the wave-cut portions of the metal plate members are bent upward. As the metal plate members are bent, curved portions of elbows are formed at a gentle angle when the elbows are formed (step S 14).

As shown in FIG. 5, the metal plate members passing through the ball caster 420 are transferred by the transfer rollers 530 connected to the universal joint 520, as a rotating force generated by the first motor 510 is delivered to the transfer rollers 530.

The metal plate members transferred in such a manner are supplied to the joint jig 650, the single folded portion and the double folded portion of the metal plate members are pressed by the upper and lower pressing rollers 622 and 624 installed at the lower end of the joint jig 650, and the elbow of the pressed spiral duct is rocked along the curved line of the wave-cut portions.

The upper cutter 661 is installed to project forward from the joint jig 650, but is lifted. Therefore, the upper cutter 661 can be prevented from interfering with the spiral duct which is rocked while being formed.

At this time, the lifted state of the upper cutter 661 is maintained by the first cylinder 666. As the first cylinder 666 retreats, the link 665 is rotated about one of its sides. As the link 665 is rotated, the frame 663 is lifted upward with respect to the hinge shaft 664, so that the upper cutter 661 is lifted.

The lower cutter 662 is lowered along the rail 667 as the second cylinder 669 and the link 668 retreat. The upper and lower cutters 661 and 662 are separated from each other while the elbow of the spiral duct is manufactured by the joint jig 650.

The metal plate members supplied in such a manner are formed in an elbow shape by the joint jig 650. As shown in FIG. 9, since the curved surface of the elbow of the spiral duct is bent by the ball caster 420, the outer circumference of the elbow forms a smooth curve, not a polygonal shape with abrupt bends (step S 15).

When the elbow is formed, the encoder measures the length of the metal plate members separately from the length of the portion cut by the wave bending unit 200. When the elbow is formed with the length of an elbow which is to be formed, the elbow is cut by the cutter installed in front of the joint jig 650.

When formation of the elbow is completed, a boss is formed in a straight line. Then, to cut the elbow, the upper and lower cutters 661 and 662 are engaged with each other, and the rotating device 670 rotates so as to cut the elbow in a straight line.

The rotation angle of the rotating device is calculated depending on specifications of the elbow. For example, the angle is properly controlled in the range of 0-33 degrees, depending on the size of the elbow.

The rotation of the rotating device 670 is performed as follows: the driving gear 672 is rotated by power applied to the servo motor 673, and the driven gear 671 geared with the driving gear 672 is rotated, so that the entire frame 663 is rotated. As the rotating device 670 rotates, the upper and lower cutters 661 and 662 are rotated. In a state where the upper and lower cutters 661 and 662 are rotated by a predetermined angle, the elbow is cut into a straight line (step S 16).

After the elbow is cut, the metal plate member is continuously supplied from the uncoiler 100. The process of forming the elbow is repeatedly performed.

[Industrial Applicability]

According to the present invention, the projecting wave portions of the metal plate members are bent so as to form the elbow. Therefore, it is possible to manufacture an elbow which is curved at a gentle angle. Accordingly, fluid can flow smoothly along the curved portion of the elbow.

Further, as the elbow is formed by consecutive processes, it is possible to increase productivity.

While the invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A manufacturing apparatus of a spiral duct including an elbow, comprising:

a wave bending unit that upwardly bends projecting wave portions metal plate members supplied in a state where the metal plate members are cut in such a manner that a straight line and waves are formed, the straight line having a double folded portion, and the respective waves having a single folded portion;

a transfer unit that transfers the metal plate members having the bent wave portions; and a forming and cutting unit that forms the metal plate members transferred from the transfer unit into a cylindrical spiral shape, presses the metal plate members to form an elbow, and then cuts the metal plate members, wherein the forming and cutting unit includes:

a lower pressing roller that is installed so as to be rotated by power received from a driving motor;

an upper pressing roller that is installed above the lower pressing roller so as to press the bent metal plate members;

a fixing device that is installed above the upper pressing roller and has a joint jig fixed thereto, the joint jig forming the metal plate members transferred from the transfer unit into a cylindrical shape;

a cutter that is composed of upper and lower cutters which are installed on front surfaces of the upper and lower pressing rollers, respectively, so as to cut the metal plate members formed into a cylindrical shape by the joint jig; and a rotating device that rotates the cutter about an axis which is parallel to axes of the upper and lower pressing rollers using a driving force of a servo motor, wherein the joint jig includes:

a plurality of divided pieces that are divided in a circular arc shape;

a plurality of self-aligning bearings that are coupled to the respective divided pieces such that the divided pieces freely move without interfering with the advancing direction of an elbow formed by the joint jig, wherein the divided pieces of the joint jig have a moving plate which is bent toward one surface and inner curve of the divided pieces so as to guide a metal plate members entering the joint jig in a state where the entered metal plate members are held.

2. The manufacturing apparatus according to claim 1, wherein the wave bending unit includes:

a ball caster that advances and retreats so as to upward bend the wave portions of the metal plate members having continuously cut lines and waves upward;

a cam that is installed at one side of the ball caster and is retreated by projecting wave portions of the metal plate members; and an inclined plate that is installed in such a manner that the cam is lifted and lowered along a top surface thereof by the advancing and retreating of the ball caster.

3. The manufacturing apparatus according to claim 1, wherein the transfer unit includes a pair of upper and lower transfer rollers which are installed so as to be rotated by a universal joint coupled to a first motor and transfer the metal plate members.

4. The manufacturing apparatus according to claim 2, wherein the wave bending unit includes a detection sensor which detects entrance of the projecting wave portions of the metal plate members supplied in a cut state where lines are continuous with waves.

5. The manufacturing apparatus according to claim 1, wherein the forming and cutting unit includes; an idle sprocket that transmits power of the second driving motor; and an encoder that measures the length of the metal plate members supplied by the rotation of the sprocket.

6. The manufacturing apparatus according to claim 1, wherein the fixing device includes a second moving portion coupled to a vertical guide rail so as to fix the joint jig and a first moving portion coupled to a horizontal guide rail, the first moving portion being coupled to one side of the second moving portion.

7. The manufacturing apparatus according to claim 1, wherein the joint jig further includes:

a plurality of cylinders that extend from one side of the respective divided pieces and are coupled in such a manner that the joint jig freely moves.

8. The manufacturing apparatus according claim 1, wherein the rotating device includes:

a servo motor that is installed at one side of a frame;

a driving gear that is rotated by a driving force of the servo motor; and a driving gear that is geared with the driving gear so as to rotate the frame.

9. The manufacturing apparatus according to claim 5, wherein a hinge shaft serving as the center of rotation is installed under a frame having the upper cutter installed at one side thereof, a link is installed at the other side of the frame so as to rotate about a fixed one end of the link, and a first cylinder is installed on the link.

10. The manufacturing apparatus according to claim 5, wherein a rail is vertically formed under the lower pressing roller, a link for lifting and lowering the lower cutter is installed at one side of the rail, and a second cylinder is installed on the link.

11. The manufacturing apparatus according to claim 1, wherein the lower pressing roller has a second gear integrally formed thereon, the second gear being geared with the first gear formed in sprocket which is rotated by a second driving motor, and the upper pressing roller has a third gear integrally formed thereon, the third gear being geared with the second gear.

12. The manufacturing apparatus according to claim 9, wherein the link is pulled by the first cylinder so as to lift the upper cutter with respect to the hinge shaft, and the lifted state is maintained in such a manner that the upper cutter does not interfere with an elbow which is to be formed.

13. The manufacturing apparatus according to claim 8, wherein the rotating device rotates the frame in the range of 0-33 degrees depending on the length measured by an encoder such that the elbow formed by the joint jig is cut in a straight line.

14. The manufacturing apparatus according to claim 1 further comprising:

an uncoiler that is provided in front of the wave bending unit and around which the metal plate member is wound; and a wave cutting unit that cuts the metal plate member supplied from the uncoiler such that lines are continuous with waves.

15. A manufacturing method of a spiral duct including an elbow, using a manufacturing apparatus of the spiral duct including the elbow, the apparatus comprising: a wave bending unit that upwardly bends projecting wave portions of metal plate members supplied in a state where the metal plate members are cut in such a manner that a straight line and waves are formed, the straight line having a double folded portion, and the respective waves having a single folded portion; a transfer unit that transfers the metal plate members having the bent wave portions; and a forming and cutting unit that forms the metal plate members transferred from the transfer unit into a cylindrical spiral shape, presses the metal plate members to form an elbow, and then cuts the metal plate members, wherein the forming and cutting unit includes: a lower pressing roller that is installed so as to be rotated by power received from a second driving motor; an upper pressing roller that is installed above the lower pressing roller so as to press the bent metal plate members; a fixing device that is installed above the upper pressing roller and has a joint jig fixed thereto, the joint jig forming the metal plate members transferred from the transfer unit into a cylindrical shape; a cutter that is composed of upper and lower cutters which are installed on front surfaces of the upper and lower pressing rollers, respectively, so as to cut the metal plate members formed into a cylindrical shape by the joint jig; and a rotating device that rotates the cutter about an axis which is parallel to axes of the upper and lower pressing rollers using a driving force of a servo motor, wherein the joint jig includes:

a plurality of divided pieces that are divided in a circular arc shape;

a plurality of self-aligning bearings that are coupled to the respective divided pieces such that the divided pieces freely move without interfering with the advancing direction of an elbow formed by the joint jig, wherein the divided pieces of the joint jig have a moving plate which is bent toward one surface and inner curve of the divided pieces so as to guide a metal plate members entering the joint jig in a state where the entered metal plate members are held, comprising:

transferring the metal plate member using a pair of transfer rollers which are rotated by a first motor installed in the manufacturing apparatus of the spiral duct including the elbow;

pressing the single folded portions and the double folded portion of the transferred metal plate members using the upper and lower pressing rollers while the transferred metal plate members are rolled into a circular shape by the joint jig; and cutting the elbow formed by the manufacturing apparatus using the upper and lower cutters.

16. The manufacturing method according to claim 15, further comprising bending projecting wave portions of the metal plate members upward by a ball caster, the metal plate members being cut in such a manner that a the straight line and waves are formed before the transferring the metal plate members, wherein, in the bending of the projecting wave portions of the metal plate members, a detection sensor detects entrance of the projecting wave portions of the metal plate and then sends a detection signal to an encoder, the encoder measures the length of the supplied metal plate members, and a lower ball caster of a ball caster retreats along the projecting wave portions of the supplied metal plate members.

17. The manufacturing method according to claim 15, wherein, in the pressing of the single folded portion and the double folded portion while the metal plate members are supplied to the joint jig, the single folded portion and the double folded portion are pressed by the upper and lower pressing rollers.

18. The manufacturing method according to claim 15, wherein, in the cutting of eh elbow, the upper cutter is lifted while a frame is lifted with respect to a hinge shaft, and the lower cutter is lowered along a rail when the elbow is formed.

* * * * *